US009734775B2

(12) United States Patent
Davis et al.

(10) Patent No.: US 9,734,775 B2
(45) Date of Patent: Aug. 15, 2017

(54) DISPLAY POWER SAVING UTILIZING NON VOLATILE MEMORY

(71) Applicant: Lenovo (Singapore) Pte. Ltd., Singapore (SG)

(72) Inventors: Mark Charles Davis, Durham, NC (US); Howard J. Locker, Cary, NC (US); Scott Edwards Kelso, Cary, NC (US); Steven Richard Perrin, Raleigh, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 4 days.

(21) Appl. No.: 14/179,708

(22) Filed: Feb. 13, 2014

(65) Prior Publication Data

US 2015/0228235 A1 Aug. 13, 2015

(51) Int. Cl.
*G09G 3/36* (2006.01)

(52) U.S. Cl.
CPC ... *G09G 3/3611* (2013.01); *G09G 2300/0857* (2013.01); *G09G 2330/021* (2013.01)

(58) Field of Classification Search
CPC ..... G09G 5/00; G09G 2300/0857; G09G 2300/021
See application file for complete search history.

(56) References Cited

U.S. PATENT DOCUMENTS

2002/0149598 A1* 10/2002 Greier et al. ..... 345/589
2003/0020684 A1* 1/2003 Edwards et al. ..... 345/98
2004/0085283 A1* 5/2004 Wang ..... G09G 5/005 345/100
2007/0002036 A1* 1/2007 Kardach et al. ..... 345/213
2007/0200839 A1* 8/2007 Sampsell ..... G09G 3/20 345/204
2009/0231232 A1* 9/2009 Chan ..... G06F 1/266 345/1.3
2010/0207952 A1* 8/2010 Mani et al. ..... 345/531

* cited by examiner

*Primary Examiner* — Ariel Balaoing
(74) *Attorney, Agent, or Firm* — Schwegman Lundberg & Woessner, P.A.

(57) ABSTRACT

A device includes a controller configured to receive information for display, an LCD display coupled to the controller, the LCD display comprising an array of pixel elements, and a non-volatile random access memory (NVRAM) coupled to the controller and to the LCD display to receive data for each pixel element and provide that data to the pixel elements for display.

21 Claims, 3 Drawing Sheets

DISPLAY POWER SAVING UTILIZING NON VOLATILE MEMORY

BACKGROUND

Light crystal displays (LCD) consume a significant amount of power in mobile electronic devices. Some displays have a self-refresh protocol that allows a connected system to power down electronics that provide pixel information to the display. The display contains a controller having random access memory that retains current pixel information. The display controller continues to refresh display pixels using the memory retained pixel information for continued display of static information.

SUMMARY

A device includes a controller configured to receive information for display, an LCD display coupled to the controller, the LCD display comprising an array of pixel elements, and a non-volatile random access memory (NVRAM) coupled to the controller and to the LCD display to receive data for each pixel element and provide that data to the pixel elements for display.

A method includes receiving a self-refresh command at a controller of a liquid crystal display (LCD) device, placing a non-volatile random access memory (NVRAM) in a self-refresh mode to cause the NVRAM to provide pixel data to an array of pixel elements of the LCD to refresh the pixel elements, and continuously displaying the pixel data via the pixel elements.

A system includes a processor, a graphics adapter coupled to the processor, and a display device coupled to receive display information from the graphics adapter. The display includes a controller to receive the display information, a spin torque transfer random access memory (STT-RAM) coupled to the controller to receive pixel information from the controller based on the display information, and an array of pixels coupled to the STT-RAM to display the pixel information.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

The functions or algorithms described herein may be implemented in software or a combination of software and human implemented procedures in one embodiment. The software may consist of computer executable instructions stored on computer readable media such as memory or other type of hardware based storage devices, either local or networked. Further, such functions correspond to modules, which are software, hardware, firmware or any combination thereof. Multiple functions may be performed in one or more modules as desired, and the embodiments described are merely examples. The software may be executed on a digital signal processor, ASIC, microprocessor, or other type of processor operating on a computer system, such as a personal computer, server or other computer system. The article "a" or "an" means "one or more" unless explicitly limited to a single one.

Figure 1:
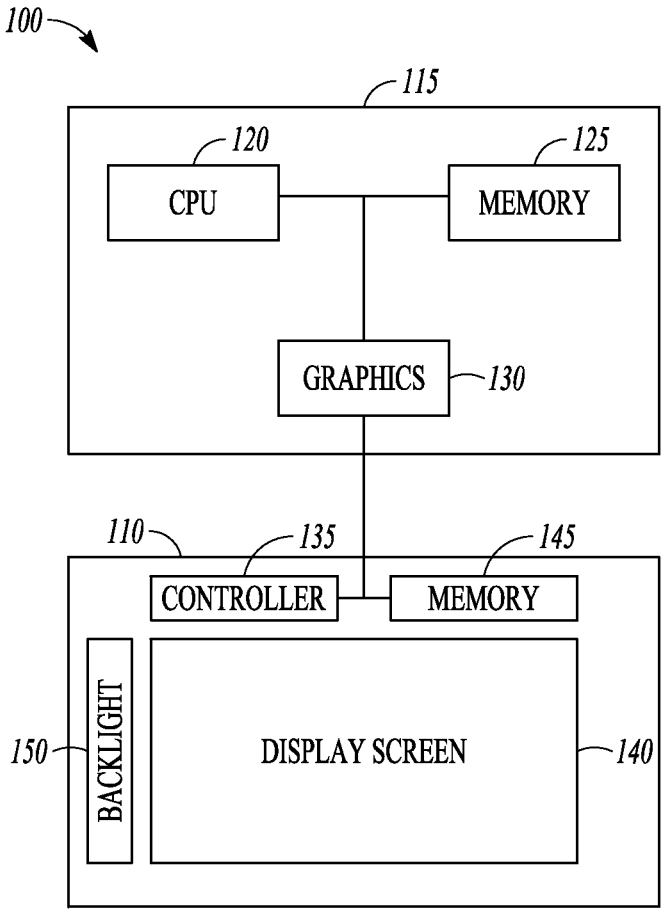
FIG. 1 is a block diagram of a device and display screen having low power modes according to an example embodiment.

FIG. 1 is a block diagram of a system 100 having a power conserving display device 110 coupled to a device 115 providing information to be displayed on the display device 110. In various embodiments, device 115 may be mobile device such as a smart phone, tablet, laptop computer, or other type of device with display device 110 being the display for the device that is integrated or otherwise coupled to display information generated on device 115.

In one embodiment, device 115 may include a central processing unit 120 coupled to a memory 125 and a graphics adapter 130, which drives the display device 110. The device 115 may have many different power saving features, allowing reduced power modes for one or more of the CPU 120 and graphics adapter 130. The graphics adapter may instruct the display device 110 to self-refresh, resulting in continued display of the last information provided by the graphics adapter 130, while the graphics adapter is in a reduced power consumption state.

Display device 110 may include a controller 135 that receives the information from graphics adapter 130 and drives an LCD display screen 140 comprising an array of pixels. A memory 145 may be used to store and provide pixel information to the display screen 140. The memory 145 in one embodiment operates under control of the controller 135 to refresh the array of pixels.

Memory 145 in one embodiment comprises a non-volatile memory that does not require refreshing to maintain the pixel information being stored. In one embodiment, the memory 145 is an array of magnetic random access memory (MRAM), which maintains its state without application of power to refresh as may be used in other forms of dynamic random access memory. MRAM memory provides fast read and write times suitable for an LCD based display screen 140. One particular form of MRAM is spin torque transfer RAM (STT-RAM) which stores a bit of information persistently without any power utilizing a spin polarized current to change the magnetic orientation of a magnetic material. Such a non-volatile memory also allows the controller 135 to be shut down when the display screen 140 is set to self-refresh mode. A backlight 150 may also be used to increase the visibility of the display.

MRAM generally consists of a magnetic material and a corresponding transistor, forming a cell. The magnetization of the magnetic material may be changed via a spin polarized writing current. Reading the cell may be accomplished using the transistor to measure a resistance of the cell which changes depending on the orientation of the magnetic field.

Figure 2:
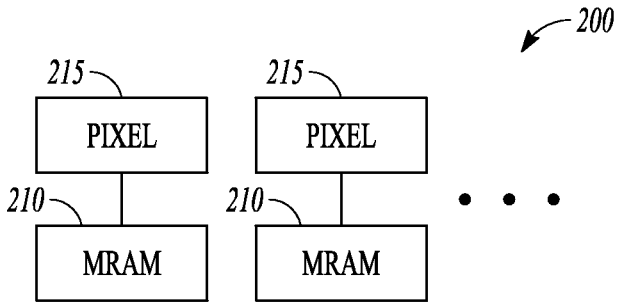
FIG. 2 is a simplified cross sectional block diagram of an array of pixels and corresponding non-volatile memory cells according to an example embodiment.

In one embodiment as illustrated at 200 in a cross sectional block form in FIG. 2, an MRAM memory cell 210 may be positioned at least partially beneath each corresponding pixel element 215 or other embedded in a display cell to store data to drive the pixel, as opposed to in an array separate from the pixels of the display screen 140. Standard semiconductor processing techniques used to form the pixel elements and related conductive paths may also be used to form the memory cells and related read and write conductive paths. In further embodiments, the memory cell 210 may be placed beneath or behind each pixel relative to the direction the pixel is intended to be viewed, or nearby or adjacent to each pixel on the same level or a level near a level the memory cell is formed on in a manner designed not to interfere with viewing of the pixels. If the memory cells are transparent to the eye and do not interfere with viewing of the pixels, they may also be placed in front of the pixel.

Figure 3:
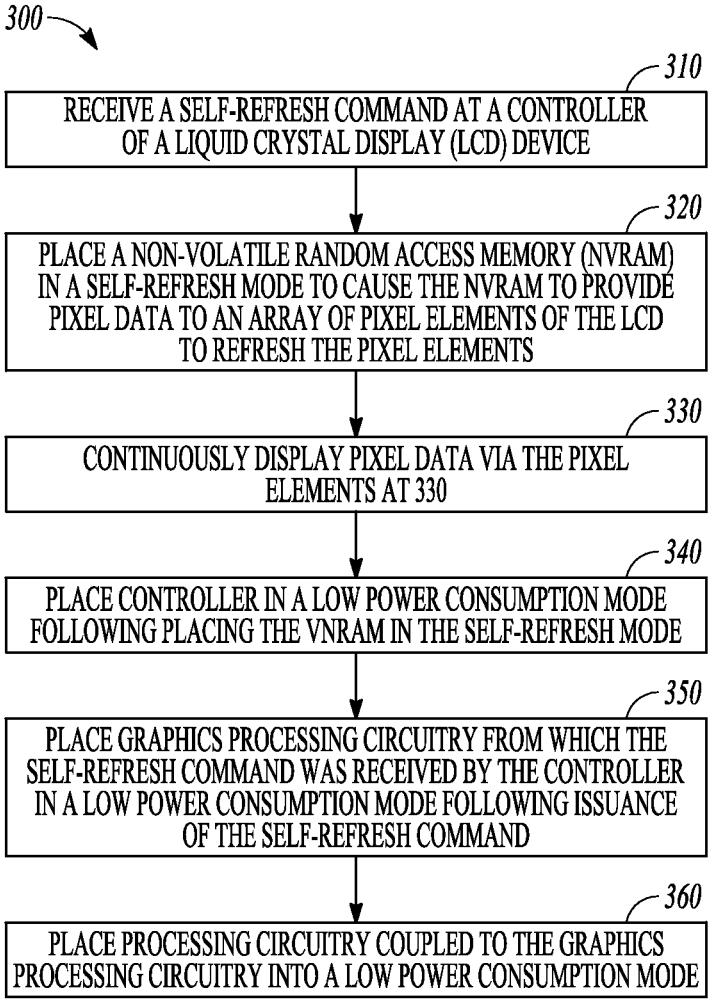
FIG. 3 is a flowchart illustrating a method of operating a display screen in a low power mode according to an example embodiment.

FIG. 3 is a flowchart illustrating a method 300 of low power operation of a display device. At 310, a self-refresh command is received at a controller of a liquid crystal display (LCD) device. At 320, a non-volatile random access memory (NVRAM) is placed in a self-refresh mode to cause the NVRAM to provide pixel data to an array of pixel elements of the LCD to refresh the pixel elements. The pixel data is continuously displayed via the pixel elements at 330.

In one embodiment at 340, the controller may be placed in a low power consumption mode following placing the NVRAM in the self-refresh mode. In a further embodiment, graphics processing circuitry from which the self-refresh command was received by the controller may be placed in a low power consumption mode at 350 following issuance of the self-refresh command. Processing circuitry coupled to the graphics processing circuitry may also be placed into a low power consumption mode at 360.

Figure 4:
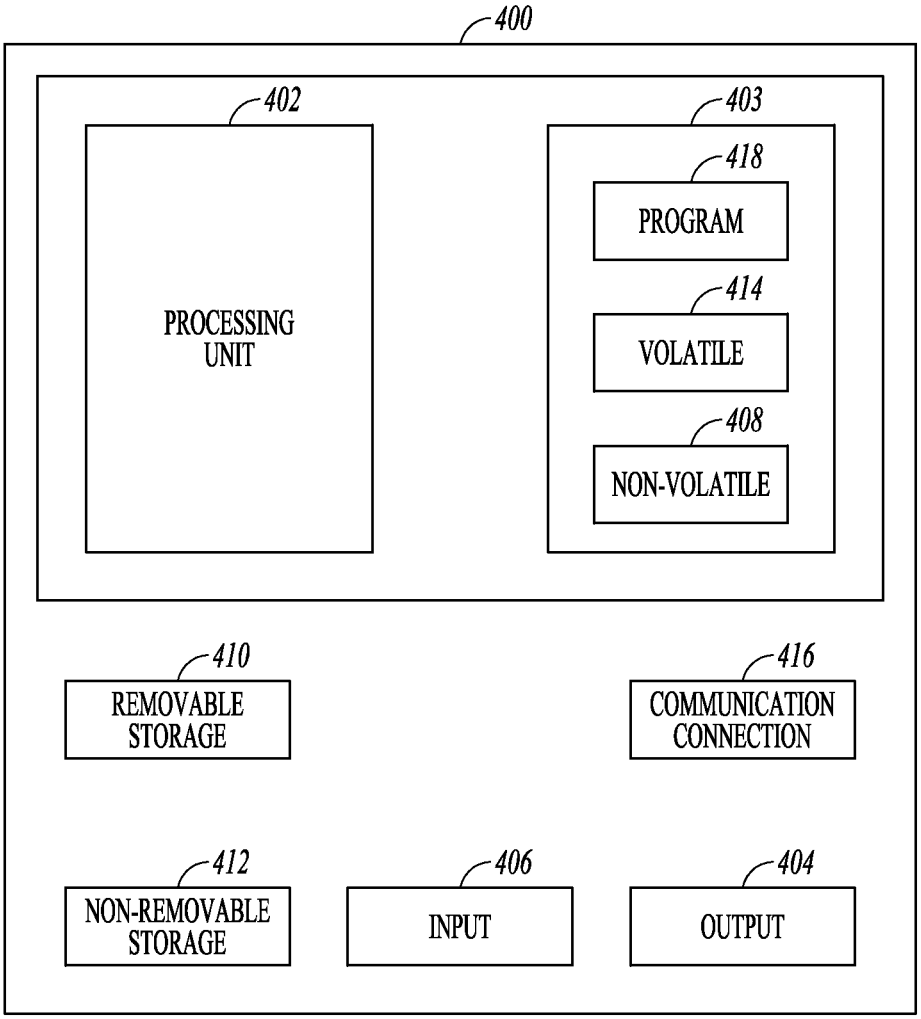
FIG. 4 is a block diagram of computer system used to implement methods according to example embodiments.

FIG. 4 is a block schematic diagram of a computer system 400 to implement device 100 and other computing resources according to example embodiments. All components need not be used in various embodiments. One example computing device in the form of a computer 400, may include a processing unit 402, memory 403, removable storage 410, and non-removable storage 412. Memory 403 may include volatile memory 414 and non-volatile memory 408. Computer 400 may include—or have access to a computing environment that includes—a variety of computer-readable media, such as volatile memory 414 and non-volatile memory 408, removable storage 410 and non-removable storage 412. Computer storage includes random access memory (RAM), read only memory (ROM), erasable programmable read-only memory (EPROM) & electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage or other magnetic storage devices, or any other medium capable of storing computer-readable instructions. Computer 400 may include or have access to a computing environment that includes input 406, output 404, and a communication connection 416. Output 404 may include a display device, such as a touchscreen, that also may serve as an input device. The computer may operate in a networked environment using a communication connection to connect to one or more remote computers, such as database servers. The remote computer may include a personal computer (PC), server, router, network PC, a peer device or other common network node, or the like. The communication connection may include a Local Area Network (LAN), a Wide Area Network (WAN) or other networks.

Computer-readable instructions stored on a computer-readable medium are executable by the processing unit 402 of the computer 400. A hard drive, CD-ROM, and RAM are some examples of articles including a non-transitory computer-readable medium. For example, a computer program 418 capable of providing a generic technique to perform access control check for data access and/or for doing an operation on one of the servers in a component object model (COM) based system may be included on a CD-ROM and loaded from the CD-ROM to a hard drive. The computer-readable instructions allow computer 400 to provide generic access controls in a COM based computer network system having multiple users and servers.

Examples

1. A device comprising:
   a controller configured to receive information for display;
   an LCD display coupled to the controller, the LCD display comprising an array of pixel elements; and
   a non-volatile random access memory (NVRAM) coupled to the controller and to the LCD display to receive data for each pixel element and provide that data to the pixel elements for display.

2. The device of example 1 wherein the non-volatile memory comprises magnetic random access memory (MRAM).

3. The device of any of examples 1-2 wherein the non-volatile memory comprises spin torque transfer random access memory (STT-RAM).

4. The device of example 3 wherein the STT-RAM comprises an array of memory cells, each memory cell corresponding to a pixel element.

5. The device of example 4 wherein each memory cell is positioned beneath each pixel element.

6. The device of any of examples 1-5 wherein the controller is configured to place the memory and array of pixel elements into a self-refresh mode.

7. The device of example 6 wherein the controller is further configured to place itself in a lower power consumption mode following placing the memory and array of pixel elements into the self-refresh mode.

8. The device of any of examples 1-7 and further comprising a backlight coupled to illuminate the array of pixel elements.

9. The device of any of examples 1-8 and further comprising:
   processing circuitry;
   a random access memory coupled to the processing circuitry; and
   graphics processing circuitry coupled to the processing circuitry to provide the information to display to the controller.

10. The device of example 9 wherein the processing circuitry and the graphics processing circuitry are configured to enter a low power mode and to provide a self-refresh command to the controller.

11. A method comprising:
   receiving a self-refresh command at a controller of a liquid crystal display (LCD) device;
   placing a non-volatile random access memory (NVRAM) in a self-refresh mode to cause the NVRAM to provide pixel data to an array of pixel elements of the LCD to refresh the pixel elements; and
   continuously displaying the pixel data via the pixel elements.

12. The method of example 11 and further comprising placing the controller in a low power consumption mode following placing the NVRAM in the self-refresh mode.

13. The method of example 12 and further comprising placing graphics processing circuitry from which the self-refresh command was received by the controller in a low power consumption mode following issuance of the self-refresh command.

14. The method of example 13 and further comprising placing processing circuitry coupled to the graphics processing circuitry into a low power consumption mode.

15. A system comprising:

a processor;

a graphics adapter coupled to the processor; and a display device coupled to receive display information from the graphics adapter, the display comprising:

a controller to receive the display information;

a spin torque transfer random access memory (STT-RAM) coupled to the controller to receive pixel information from the controller based on the display information; and an array of pixels coupled to the STT-RAM to display the pixel information.

16. The system of example 15 wherein the STT-RAM comprises an array of memory cells, each memory cell corresponding to a pixel element.

17. The system of example 16 wherein each memory cell is positioned beneath each pixel element.

18. The system of any of examples 15-17 wherein the controller is configured to place the memory and array of pixel elements into a self-refresh mode.

19. The system of example 18 wherein the controller is further configured to place itself in a lower power consumption mode following placing the memory and array of pixel elements into the self-refresh mode.

20. The system of any of examples 15-19 and further comprising a backlight coupled to illuminate the array of pixel elements.

21. A device comprising:

a controller configured to receive information for display;

an LCD display coupled to the controller, the LCD display comprising an array of pixel elements;

a non-volatile random access memory (NVRAM) coupled to the controller and to the LCD display to receive data for each pixel element and provide that data to the pixel elements for display;

processing circuitry;

a random access memory coupled to the processing circuitry; and graphics processing circuitry coupled to the processing circuitry to provide the information to display to the controller.

22. The device of claim 21 wherein the processing circuitry and the graphics processing circuitry are configured to enter a low power mode and to provide a self-refresh command to the controller.

23. The device of claim 21 wherein the non-volatile memory comprises spin torque transfer random access memory (STT-RAM).

24. The device of claim 23 wherein the STT-RAM comprises an array of memory cells, each memory cell corresponding to a pixel element.

Although a few embodiments have been described in detail above, other modifications are possible. For example, the logic flows depicted in the figures do not require the particular order shown, or sequential order, to achieve desirable results. Other steps may be provided, or steps may be eliminated, from the described flows, and other components may be added to, or removed from, the described systems. Other embodiments may be within the scope of the following claims.

The invention claimed is:

1. A display device comprising:

a controller to couple to a graphics adapter external to the display device to receive information for display by the display device;

an LCD display coupled to the controller, the LCD display comprising an array of pixel elements; and a non-volatile random access memory (NVRAM) coupled to the controller and to the LCD display to receive data from the controller for each pixel element and provide that data to the pixel elements for display, wherein the NVRAM comprises memory cells embedded in each pixel element, such embedded memory cells coupled to provide pixel data to the pixel element with which it is embedded; wherein the display device is operable to self-refresh to enable the graphics adapter to enter a reduced power consumption state during continued display of the last information provided by the graphics adapter.

2. The device of claim 1 wherein the non-volatile memory comprises magnetic random access memory (MRAM), and wherein the information for display is received from a graphics adapter, and wherein the MRAM refreshes the array of pixel elements under control of the controller.

3. The device of claim 1 wherein the non-volatile memory comprises spin torque transfer random access memory (STT-RAM).

4. The device of claim 3 wherein the STT-RAM comprises an array of memory cells embedded with each memory cell corresponding to a pixel element.

5. The device of claim 4 wherein each memory cell is positioned beneath each pixel element.

6. The device of claim 1 wherein the controller is to place the memory and array of pixel elements into a self-refresh mode.

7. The device of claim 6 wherein the controller is further operable to place itself in a lower power consumption mode following placing the memory and array of pixel elements into the self-refresh mode.

8. The device of claim 1 and further comprising a backlight coupled to illuminate the array of pixel elements.

9. A device comprising:

a controller to receive information for display;

an LCD display coupled to the controller, the LCD display comprising an array of pixel elements;

a non-volatile random access memory (NVRAM) coupled to the controller and to the LCD display to receive data for each pixel element from the controller and provide that data to the pixel elements for display, wherein the NVRAM comprises memory cells embedded in each pixel element, such embedded memory cells coupled to provide pixel data to the pixel element with which it is embedded;

processing circuitry;

a random access memory coupled to the processing circuitry; and graphics processing circuitry coupled to the processing circuitry to provide the information to display to the controller; wherein the controller is operable to place the memory and array of pixel elements into a self-refresh mode, and wherein the controller is further operable to place itself in a lower power consumption mode following placing the memory and array of pixel elements into the self-refresh mode.

10. The device of claim 9 wherein the processing circuitry and the graphics processing circuitry are operable to enter a low power mode and to provide a self-refresh command to the controller.

11. The device of claim 9 wherein the non-volatile memory comprises spin torque transfer random access memory (STT-RAM).

12. The device of claim 11 wherein the SIT-RAM comprises an array of memory cells, each memory cell corresponding to a pixel element.

13. A method comprising:

receiving a self-refresh command at a controller of a liquid crystal display (LCD) device;

placing a non-volatile random access memory (NVRAM) in a self-refresh mode to cause the NVRAM to provide pixel data received from the controller to an array of pixel elements of the LCD to refresh the pixel elements, wherein the NVRAM comprises memory cells embedded in each pixel element, such embedded memory cells coupled to provide pixel data to the pixel element with which it is embedded;

continuously displaying the pixel data via the pixel elements; and placing the controller in a low power consumption mode following placing the NVRAM in the self-refresh mode.

14. The method of claim 13 and further comprising placing graphics processing circuitry from which the self-refresh command was received by the controller in a low power consumption mode following issuance of the self-refresh command.

15. The method of claim 14 and further comprising placing processing circuitry coupled to the graphics processing circuitry into a low power consumption mode.

16. A system comprising:

a processor;

a graphics adapter coupled to the processor; and a display device coupled to receive display information from the graphics adapter, the display comprising:

a controller to receive the display information;

a spin torque transfer random access memory (STT-RAM) coupled to the controller to receive pixel information from the controller based on the display information; and an array of pixels coupled to the STT-RAM to display the pixel information, wherein the STT-RAM comprises memory cells embedded in each pixel, such embedded memory cells coupled to provide pixel data to the pixel with which it is embedded.

17. The system of claim 16 wherein the STT-RAM comprises an array of memory cells, each memory cell corresponding to a pixel element.

18. The system of claim 17 wherein each memory cell is positioned beneath each pixel element.

19. The system of claim 16 wherein the controller is operable to place the memory and array of pixel elements into a self-refresh mode.

20. The system of claim 19 wherein the controller is further operable to place itself in a lower power consumption mode following placing the memory and array of pixel elements into the self-refresh mode.

21. The system of claim 16 and further comprising a backlight coupled to illuminate the array of pixel elements.

* * * * *